US005918457A

United States Patent [19]

Döbbeling et al.

[11] Patent Number: 5,918,457

[45] Date of Patent: Jul. 6, 1999

[54] METHOD OF OPERATING A PLANT WITH STAGED COMBUSTION

[75] Inventors: Klaus Döbbeling, Windisch, Switzerland; Dieter Winkler, Lauchringen, Germany; Wolfgang Polifke, Windisch, Switzerland; Thomas Sattelmayer, Mandach, Switzerland

[73] Assignee: ABB Research Ltd., Zurich, Switzerland

[21] Appl. No.: 08/654,119

[22] Filed: May 28, 1996

[30] Foreign Application Priority Data

Jun. 26, 1995 [DE] Germany ..... 195 23 093

[51] Int. Cl.[6] ..... F02C 1/00; F23R 3/34

[52] U.S. Cl. ..... 60/39.06; 60/737; 60/746; 431/8

[58] Field of Search ..... 60/39.06, 737, 60/722, 746, 734; 431/8

[56] References Cited

PUBLICATIONS

Kolb T., Sybon, G.: No x—Emissionsminderung durch dreistufige Berbrennung: Optimerung der Reduktionsstufe. In: BWK, Bd. 44, 1992, Nr. 11, Nov.,, S.481–484.

*Primary Examiner*—Timothy S. Thorpe
*Assistant Examiner*—Ted Kim
*Attorney, Agent, or Firm*—Burns, Doane, Swecker & Mathis, L.L.P.

[57] ABSTRACT

In a method of operating a plant with staged combustion, the first combustion stage (1*a*) is operated with a fuel/air mixture (3) whose air coefficient is larger than the overall air coefficient of the combustion system. The hot combustion gases (5) from the first combustion stage (1*a*) are mixed with an additional fuel/air mixture (4) whose air coefficient is smaller than the overall air coefficient of the combustion system, before the further combustion in the second stage (2*a*) takes place. Since hot-gas backmixing is no longer required in the second stage (2*a*) for the flame stabilization, this combined mixture burns without the formation of further NO*x* emissions.

1 Claim, 1 Drawing Sheet

METHOD OF OPERATING A PLANT WITH STAGED COMBUSTION

BACKGROUND OF THE INVENTION

1. Field of the Invention

The present invention relates to a method of operating a plant with a graduated combustion system according to the preamble of claim 1.

2. Discussion of Background

From many publications, the person skilled in the art in the field of combustion has in the meantime become conversant with the fact that premixed combustion leads to very low pollutant emissions. In this case, the NO*x* and CO emissions are prominent here. Great efforts are being made on all sides in order to minimize them. The premixed combustion certainly exhibits its special features and advantages in particular when the fuels used are classed among the so-called "clean fuels", which are characterized in that they contain no nitrogen combined with the fuel and no sulfur portions or sulfur compounds. A further reduction in the pollutant emissions can be achieved if the combustion in its entirety is subdivided, for example if all the combustion air available is subdivided into partial flows, these partial flows, in accordance with their quantity, being mixed with various fuel contents. Furthermore, in such a combustion technique, it is then of importance that the leanest partial flow be used for the flame stabilization. Premixed combustion also requires a backflow and mixing zone for the flame stabilization in order to ignite the inflowing fuel/air mixture by further admixing with a hot gaseous medium, for example with an exhaust gas. Numerical calculations with extensive reaction mechanisms have shown that the intensive mixing zone forming from this admixing makes a considerable contribution to the formation of NO*x*. One possibility of reducing the tendency of the mixing zone to form NO*x* is to make the fuel/air mixture even leaner. However, this measure regularly leads to the extinction of the flame in the conventional burner constructions or fuel systems.

SUMMARY OF THE INVENTION

Accordingly, one object of the invention as defined in the claims is to minimize the pollutant emissions, in particular as far as the NO*x* emissions are concerned, in a method of the type mentioned at the beginning.

This is achieved by virtue of the fact that the extinction of the flame when the fuel/air mixture in the first combustion stage is made leaner, also called flame-stabilization zone below, is prevented by increasing and intensifying the mixture in this very same zone.

Furthermore, so that the integrity of the fuel/air mixture is retained with an fixed overall air coefficient of the combustion system within the second combustion stage, a portion of the combustion air having a larger fuel content is directed passed the flame-stabilization zone into the hot combustion gas. Since hot-gas backmixing is now no longer required for the flame stabilization, the mixture now burns without significant further NO*x* formation.

As far as the air coefficient is concerned, which in the literature is often identified with the Greek letter "lambda", it may be said that this represents a coefficient which results from the actual air/fuel ratio relative to the stoichiometric air/fuel ratio.

A considerable advantage of the invention may therefore be seen in the fact that, apart from good flame stabilization, a considerable reduction in the NOx emissions can be achieved. The invention with a flame-stabilization zone operated on a lean mixture produces 50% less NO*x* compared with the combustion techniques pertaining to the prior art.

The invention is also simple to realize in a practical form by the graduated combustion first of all being initiated with a relatively large flame-stabilization zone having a lean fuel/air mixture. Here, the hot gas not yet completely burnt-up is mixed with the remaining somewhat richer fuel/air mixture after leaving this zone in order to subsequently be burnt in a second combustion stage. The combustion gases from the flame-stabilization zone are still so hot that the fuel/air mixture additionally introduced ignites spontaneously without special flame-stabilization measures and burns up completely.

Advantageous and expedient further developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
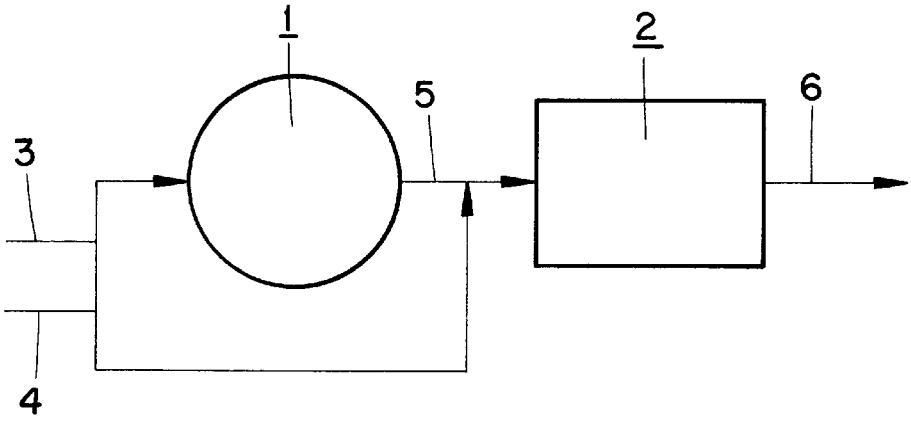
FIG. 1 shows a schematic representation of lean flame stabilization with graduated fuel/air conduction.

Referring now to the drawings, wherein like reference numerals designate identical or corresponding parts throughout the several views, FIG. 1 shows a schematic representation of lean mixture-stabilized flame stabilization with reference to graduated fuel/air conduction. The ultimate purpose of this graduated fuel/air conduction is to obtain the overall air coefficient of the combustion system via the different combustion stages through appropriate subdivision at a predetermined level. For this purpose, the first combustion stage 1 is operated as a flame-stabilization zone. The fuel/air mixture 3 used here has an air coefficient which is larger than the overall air coefficient of the combustion system, the combustion air used here logically being only a partial quantity of the entire air flow available; thus the combustion system is operated with a lean fuel/air mixture 3 within this zone. The further portion of the combustion air receives a larger fuel content in such a way that the fuel/air mixture 4 appearing here has an air coefficient which is smaller than the said overall air coefficient of the combustion system; therefore the combustion system is operated here with a richer fuel/air mixture. As far as the overall air coefficient of the combustion system is concerned, it is preferably 2 for combustion chambers of gas turbines, variations up or down being possible, depending on parameters. An overall air coefficient of the combustion system of 2 can be achieved if the air coefficient in the case of the fuel/air mixture 3 for the flame-stabilization zone 1 is raised to 2.4 and that for the second combustion stage 2 is still 1.4, a dwell time within the flame-stabilization zone 1 of the order of magnitude of 2.4 msec being assumed in the case of these air coefficients. The last-mentioned fuel/air mixture 4, having an air coefficient smaller than the overall air coefficient, taken as a basis, of the combustion system, is directed past the flame-stabilization zone 1 into the hot combustion gases 5 from this very same zone. Since hot-gas backmixing is now no longer required for the flame stabilization, the mixture thus present burns in a second downstream combustion stage 2 without significant further formation of NO*x*. A perfectly premixed fuel/air mixture therefore prevails in this second combustion zone 2, the air coefficient of which fuel/air mixture corresponds to the overall air coefficient, taken as a basis, of the combustion system. In the case of such a circuit, it may be assumed that the NO*x* emissions, on account of the stabilization zone operated on a lean mixture, accordingly only amount to 50% of what may be achieved with conventional multi-stage combustion systems. The hot gases 6 from the second combustion stage 2 are then the working gases for admission to a downstream turbine for example.

Figure 2:
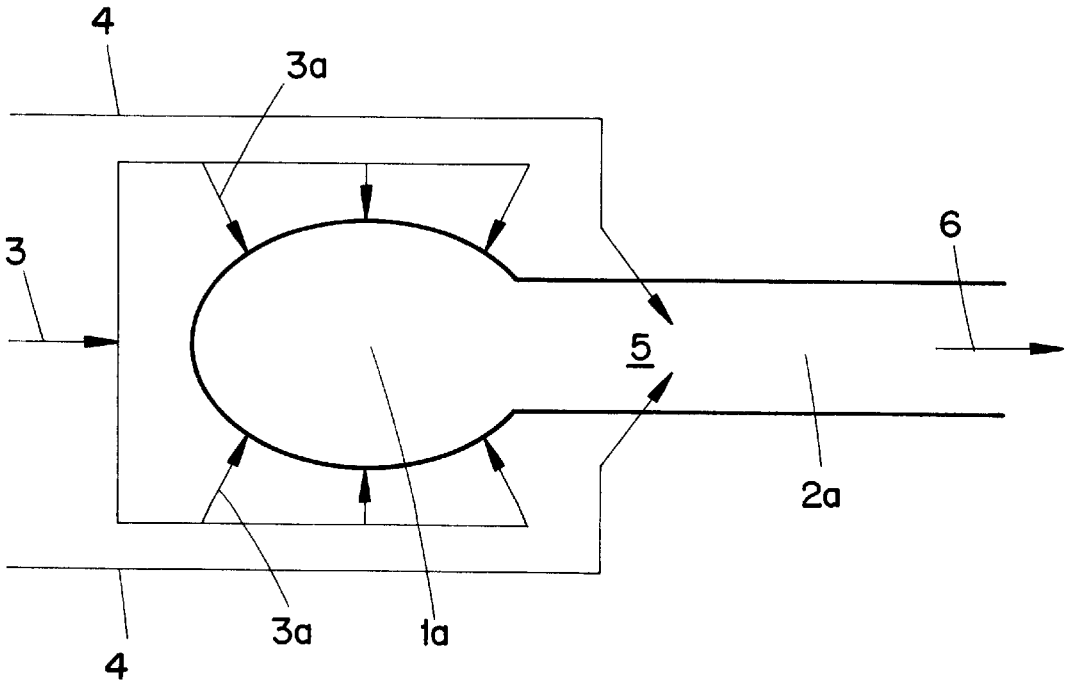
FIG. 2 shows a schematically represented embodiment variant of graduated combustion with a large flame-stabilization zone.

A practical embodiment variant of the graduated combustion having a large flame-stabilization zone 1*a* is apparent from FIG. 2. The last-mentioned zone 1*a* is of relatively large extent and is operated on a lean mixture, as already described above. To produce pronounced turbulence in this flame-stabilization zone 1*a,* whereby the properties of an ideal agitating reactor are aimed at, the lean fuel/air mixture 3 is injected into this zone 1*a* in jets 3*a* of high velocity, as apparent from FIG. 2 with reference to the variety of arrows shown. To achieve a pronounced turbulence, i.e. to achieve a fully mixed flame-stabilization zone 1*a,* a flow having a pronounced swirl or else the use of swirl or mixing elements may be provided herein. After leaving this flame-stabilization zone 1*a,* the hot, but not yet completely burnt-up, combustion gas 5 is mixed with the remaining combustion air in a downstream second combustion stage 2*a,* this air operating with a somewhat richer fuel/air mixture, i.e. the air coefficient is smaller here than the overall air coefficient of the combustion system. Since the combustion gas 5 from the flame-stabilization zone 1*a*, as already mentioned above, is sufficiently hot, the fuel/air mixture 4 directed into the second combustion stage ignites spontaneously without special flame-stabilization measures having to be provided for this purpose.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a plant with a staged combustion system to achieve a selected overall air coefficient, the plant including a first combustion stage and at least one second downstream combustion stage, the method comprising the steps of:

introducing a first fuel/air mixture into the first combustion stage for combustion therein having a first air coefficient larger than the overall air coefficient, wherein the first fuel/air mixture for the first combustion stage is given a dwell time within the first combustion stage of 2.4 msec +/−25%, and wherein the first fuel/air mixture is formed to have an air coefficient of 2.4 +/−25%, and introducing into hot combustion gases from the first combustion stage a second fuel/air mixture for a second stage combustion having a second air coefficient smaller than the overall air coefficient, wherein the second fuel/air mixture is formed to have an air coefficient of 1.4 +/−25%.

* * * * *